United States Patent [19]

Smith

[11] Patent Number: 4,804,087

[45] Date of Patent: Feb. 14, 1989

[54] SHIPPING STAND FOR LAWN AND GARDEN TRACTORS

[75] Inventor: Timothy M. Smith, Davenport, Iowa

[73] Assignee: Deere & Company, Moline, Ill.

[21] Appl. No.: 146,502

[22] Filed: Jan. 21, 1988

[51] Int. Cl.[4] ..... B65D 21/02; B65D 85/68

[52] U.S. Cl. ..... 206/335; 206/511; 206/512

[58] Field of Search ..... 206/335, 511, 512

[56] References Cited

U.S. PATENT DOCUMENTS

| | | | |
|---|---|---|---|
| 2,521,088 | 9/1950 | Phelps | 206/335 |
| 2,524,260 | 10/1950 | Hutson | 206/335 |
| 2,632,567 | 3/1953 | Richtmyer | 206/511 |
| 3,459,326 | 8/1969 | Botjemann | 206/512 |
| 3,583,581 | 6/1971 | Myers . | |
| 3,709,163 | 1/1973 | Smedley | 206/511 |
| 4,339,047 | 7/1982 | Johansson | 206/511 |

*Primary Examiner*—George E. Lowrance

[57] ABSTRACT

A stackable, knockdown shipping stand for a lawn and garden tractor includes a flat, boxlike injection molded polystyrene pallet forming a base of the stand and having a four post framework removably mounted thereon with the posts being received in stake pockets formed in the upper surface of the pallet adjacent its corners. Storage recesses are provided in the upper surface of the pallet for receiving the framework when the latter is dismantled and in the lower surface of the pallet for receiving an exposed portion of a framework located in a lower pallet when knocked-down stands are being stacked one atop another. The upper surface of the pallet, in a preferred embodiment, includes wheel wells for receiving the wheels of a tractor being shipped and a gauge roller receptacle for receiving the gauge roller of a rotary mower deck being shipped.

25 Claims, 3 Drawing Sheets

Fig. 3
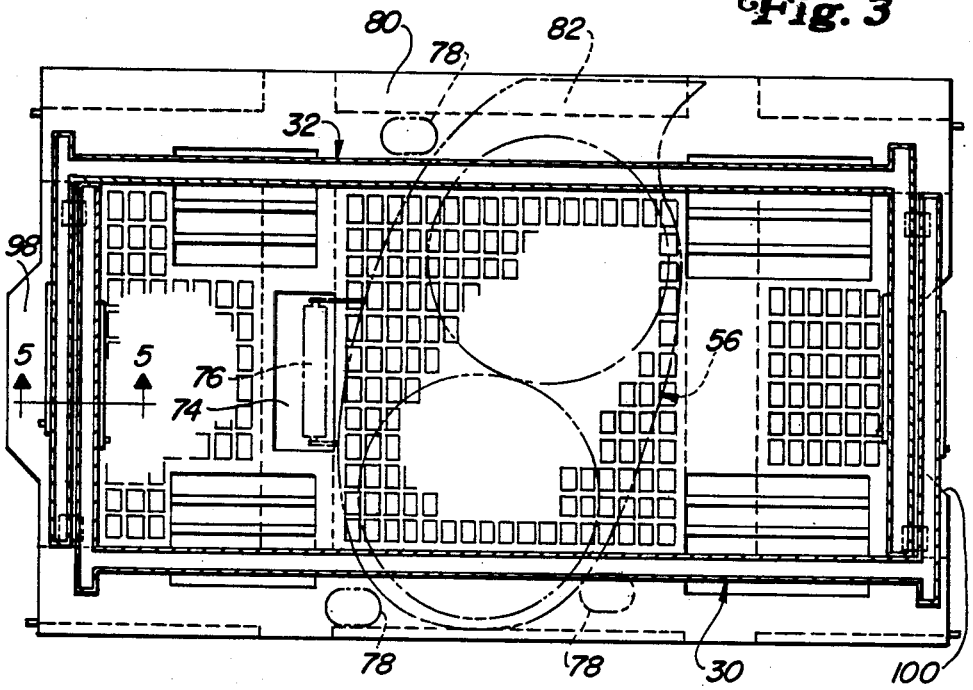
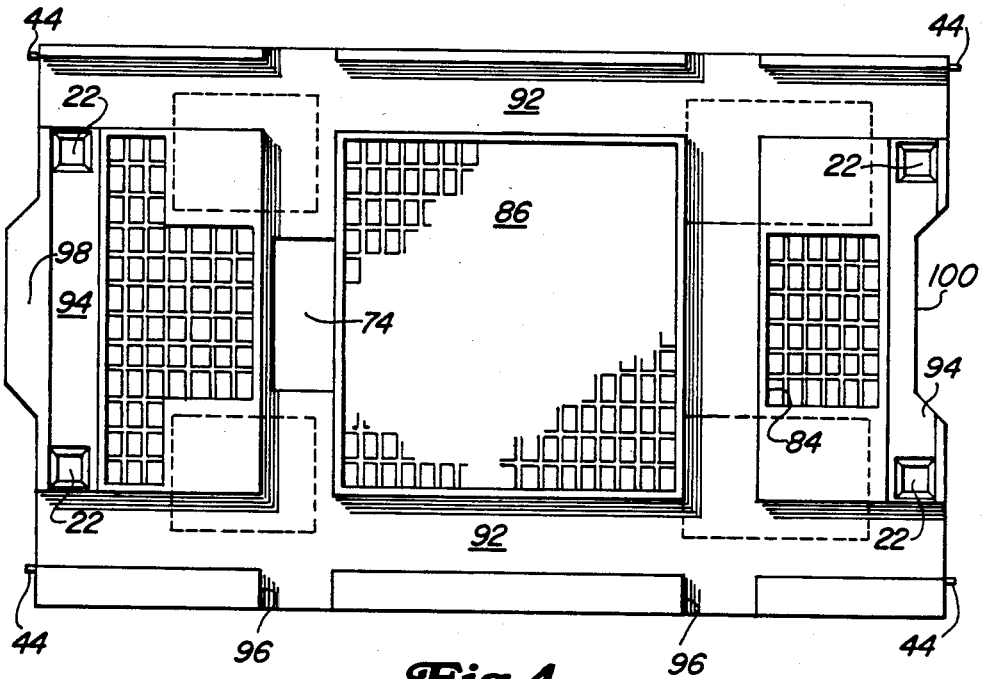
Fig. 4

SHIPPING STAND FOR LAWN AND GARDEN TRACTORS

BACKGROUND OF THE INVENTION

The present invention relates to material shipping and/or storage stands or crates and more particularly relates to stackable, knockdown stands designed for holding lawn and garden tractors.

U.S. Pat. No. 3,583,581 issued on 8 June 1971 discloses a stackable, knockdown stand or crate constructed of structural steel tubing arranged for holding lawn and garden tractors for shipping or storage. While this type of stand has been found to be adequate for holding a tractor for shipping and storage, the time required for assembling the stand is somewhat excessive, tractors must be mounted to the stand, implements cannot easily be included with the tractor carried by the stand and the structural steel tubing forming the stand is relatively expensive.

SUMMARY OF THE INVENTION

According to the present invention there is provided an improved stackable, knockdown shipping and/or storage stand for small wheeled vehicles such as lawn and garden tractors or the like.

An object of the invention is to provide a reusable, stackable, knockdown shipping and/or storage stand which can be easily and quickly assembled and disassembled.

Another object of the invention is to provide a stand of the aforementioned type which securely holds a lawn and garden tractor without requiring the tractor to be fixedly mounted to the stand.

Yet another object of the invention is to provide a stand of the aforementioned type which is particularly adapted for carrying a lawn mower together with the tractor to which the lawn mower is adapted for connection.

Still another object of the invention is to provide a stackable, knockdown shipping or storage stand adapted for having its parts compactly collected in a knocked-down state whereby a relatively large number of stands may be economically return-shipped for reuse at an originating facility such as a vehicle assembly plant, for example.

These and other objects are accomplished by providing a stand having a rectangular base in the form of a pallet constructed of injection molded polyethylene and having wheel wells formed in the upper surface thereof for receiving the wheels of the vehicle being shipped and/or stored. A further well is provided for receiving the front roller of a mower so that the latter may be shipped along with the tractor with which it is adapted for use. The four corners of the pallet are provided with openings which receive four posts forming part of stacking frames which permit pallets to be stacked one above the other. Further recesses are formed in the underside of each pallet so that when one pallet is stacked above the other the distance between the lower surface of the upper pallet and upper surface of the lower pallet is less than the height of the tractor.

The upper surface of the pallet is provided with nesting grooves and surfaces for permitting the stacking frame to be stored thereon for return shipment with the pallet.

The above and additional objects and advantages will become apparent from a reading of the ensuing description together with the appended drawings.

BRIEF DESCRIPTION OF THE DRAWINGS

FIG. 3 is a top view of the pallet of the shipping stand shown in FIG. 1 with the frame disassembled and located in nesting grooves or surfaces provided in the pallet and with portions of the nested frame being shown in section for clarity and with a rotary mower being shown in dashed lines in place on the pallet.

FIG. 4 is a bottom view of the pallet shown in FIG. 1.

DESCRIPTION OF THE PREFERRED EMBODIMENT

Figures 1, 2:
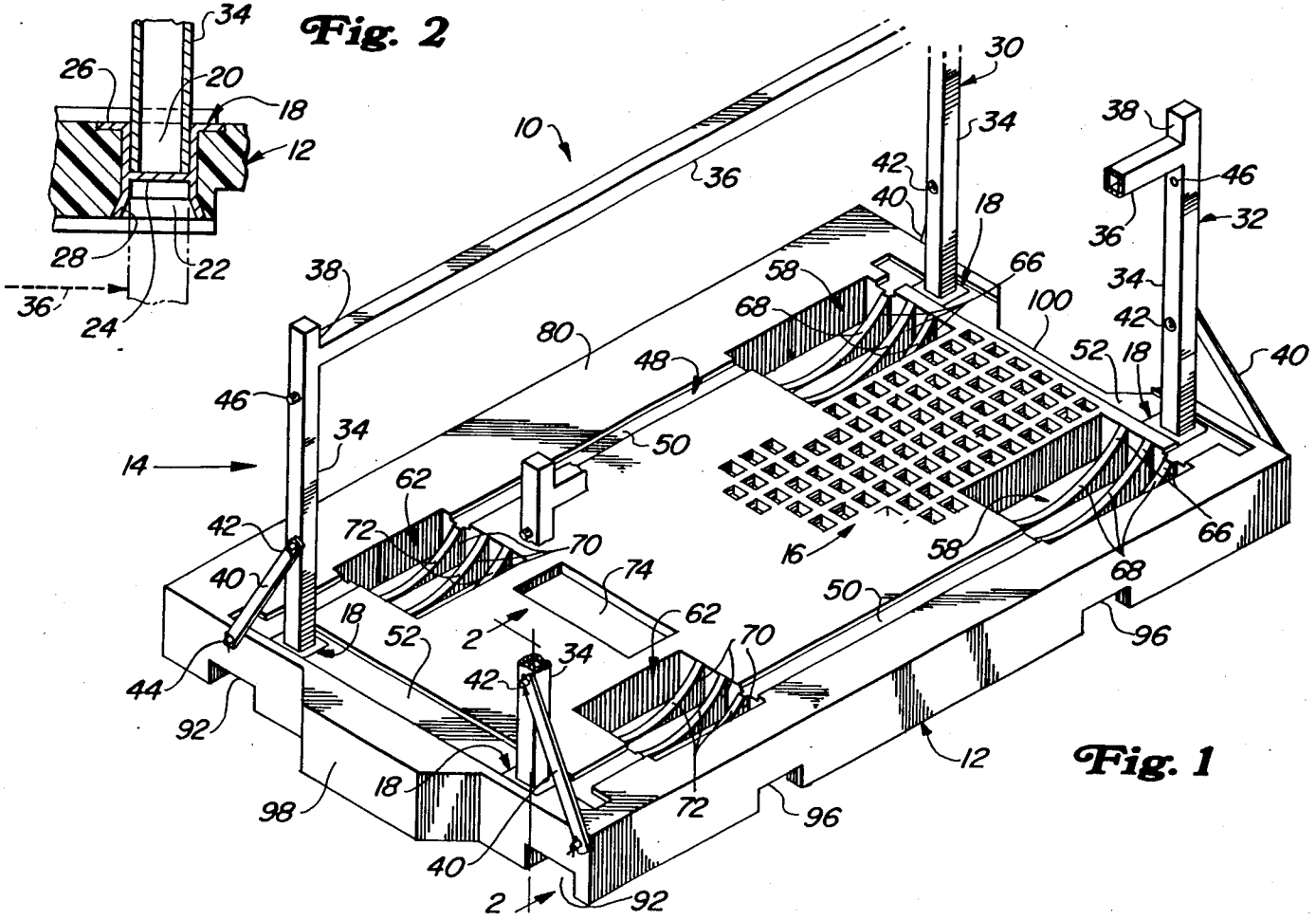
FIG. 1 is a left front perspective view of a stackable, knockdown shipping stand constructed in accordance with the principles of the present invention.
FIG. 2 is a vertical sectional view taken along line 2—2 of FIG. 1 and showing the construction of the stake pocket.
Figure 6:
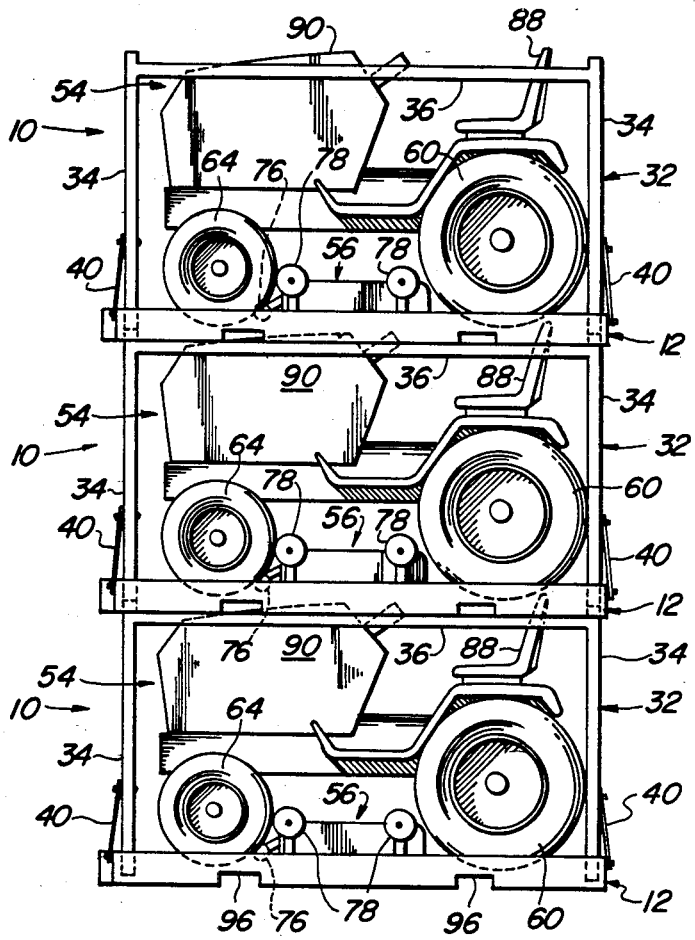
FIG. 6 is a somewhat diagrammatic side view showing a stack of three shipping stands each loaded with a lawn and garden tractor and rotary lawn mower.
Figure 5:
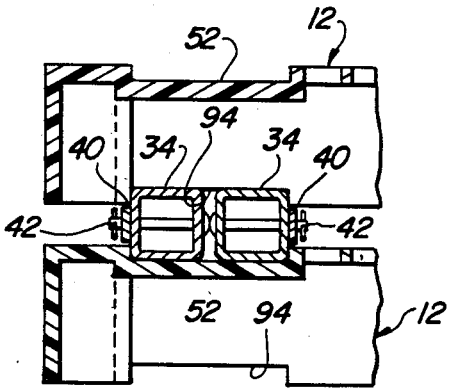
FIG. 5 is a vertical sectional view taken along line 6—6 of FIG. 3 but additionally showing a section of second pallet stacked on the pallet of FIG. 3.

Referring now to FIGS. 1–5, there is shown a knockdown shipping stand or crate 10 including a base formed by a pallet 12, which is generally rectangular in plan view, and a framework enabling a plurality of pallets 12 to be stacked. The pallet 12 is preferably made of injection molded plastic material, such as polyethylene, for example. Much of the body of the pallet 12 is honey-combed with openings 16 which extend vertically therethrough so as to form a lightweight yet strong and rigid structure. For a purpose explained below, the lower pockets 22 each include a flared entrance portion 28. As shown in FIG. 1, the framework 14 includes a pair of side frames 30 and 32, each including a pair of corner posts 34 having lower ends received in the pockets at a respective side of the pallet 12. Each side frame 30 and 32 further includes a horizontal support member 36 having its opposite ends joined to the posts 34 at respective locations spaced below the tops of the posts by a distance commensurate with the depth of the pockets 24 so as to leave upper post portions 38 for insertion into the pockets 24 when one or more of the shipping stands or crates 10 are stacked, as shown in FIG. 6, the flared entrance portions 28 of the pockets 24 serving to guide the post portions 38 into the pockets 24 during stacking operation. While any material having the requisite strength will suffice, the side frames 30 and 32 are preferably constructed of tubular structural steel. As viewed in FIG. 1, each post 34 has the upper end of a strap-like brace 40 secured thereto by a quick-releasable pin 42, the lower end of each brace being received on a pin 44 embedded in an end surface of the pallet 12 at a location outboard of the post to which the brace is attached. A further removable connection pin 46 projects horizontally through each post 34 in an orientation that is parallel to the pins 42 and at a location spaced above the pins 42 by a distance commensurate with the length of the braces 40 so that the latter may be stored against the legs 34 for shipment when the crate 10 is knocked down. A generally rectangular frame nesting or storage groove 48 is formed in the upper surface of the pallet 12 with the pockets 20 being adjacent the corners thereof. Defining opposite sides of the groove 48 are lengthwise runs 50 dimensioned for respectively snugly receiving the side frame support members 36 while the opposite ends of the groove 48 are defined by widthwise runs 52 each of which are dimensioned for snugly receiving the pair of posts 34 and stored braces 40 at a respective one of the opposite ends of the side frames 30 and 32. FIGS. 2 and 5 show the side frames 30 and 32 nested or stored in the groove 48 as they would be when the shipping stand 10 is knocked down for being loaded on a truck trailer, for example, together with other knocked-down stands for return shipment to the place of manufacture and/or shipment of lawn and garden tractors. As can be seen in FIG. 5, the nesting groove 48 extends to a relatively shallow depth which is about one-fourth of the cross-sectional dimension of the posts 34 or support members 36. This leaves room between stacked pallets 12 for the stored braces 40, which have a width of about half that of said cross-sectional dimension.

Provided in the upper surface of the pallet 12 for adding stability to a lawn and garden tractor 54 and to a rotary lawn mower deck 56 once loaded on the pallet, as shown in FIG. 6, are various recesses. Specifically, as viewed in FIGS. 1 and 3, a first pair of laterally spaced wheel wells 58 sized for receiving rear wheels 60 of the tractor 54 are located in the upper pallet surface towards the right end thereof. Similarly, a second pair of wheel wells 62, sized for receiving front wheels 64 of the tractor 54 are located in the upper pallet surface towards the left end thereof. Located in and extending lengthwise across each of the wells 58 are a plurality of parallel, spaced ribs 66 having concave upper surfaces 68, and similarly located in the wells 62 are a plurality of ribs 70 having concave upper surfaces 72. The upper rib surfaces 68 and 72 within a given wheel well 58 or 62 cooperate with each other to form a double ramp extending to the upper surface of the pallet 12 from the bottom of the well so that the tractor 54 may have its wheels driven into, from or through the wells 58 and 62 during loading or unloading the tractor on or from the pallet. Located in the pallet 12 at a location centered between the wheel wells 62 is a mower front roller receptacle 74 in the form of an opening extending vertically, through the pallet and being rectangular in top view. The receptacle 74 is sized for receiving a front roller 76 of the mower deck 56. It is here noted that the mower deck 56 shown in FIG. 4 includes a plurality of gauge wheels 78 which are vertically adjustably mounted to the deck blade housing in a known manner not shown which permits the wheels 78 to be inverted for shipment so that when the roller 76 is received the receptacle 74 the deck blade housing rests flat against the upper surface of the pallet 12. As can best be seen in FIG. 3, the pallet 12 has an outboard portion 80 which underlies and protects an outboard discharge chute portion 82 of the mower deck.

To minimize the vertical height of the stands 10 necessary for permitting the loaded stands to be stacked, the undersurface of the pallet 12 is provided with a seat clearance cavity 84 that is rectangular in plan view and located centrally between zones defined by vertical extension of the wheel wells 58. The undersurface of the pallet 12 is also provided with a hood clearance cavity 86 that is rectangular in plan view and surrounds and extends rearwardly of the roller receptacle 74. As can be seen in FIG. 6, when the stands 10 are stacked with loaded pallets 12, a seat 88 and hood 90 of the tractor loaded on a lower one of the pallets have respective upper portions that extend into the clearance cavities 84 and 86 provided in the lower surface of an upper one of the pallets. It is noted that the tractor 54 shown here has its steering post and wheel removed for shipment but that if desired the pallet 12 could be provided with a steering assembly clearance cavity which would permit the tractor to be shipped with the steering post and wheel assembled.

The pallets 12 are constructed to be handled by conventional fork lift trucks. Specifically, provided in the underside of the pallets and extending the full length thereof in areas just outboard of each pair of lower stake pockets 22 at the opposite sides of the pallet 12 are a parallel pair of fork tine grooves 92 sized to accept flat tines of a fork lift truck so as to permit the pallet to be lifted by a truck positioned at either end of the pallet. These grooves 92 also perform the function of being nesting grooves for respectively receiving the support members 36 of the side frames 30 and 32 when the latter are positioned for shipment, as shown in FIG. 3. Cooperating with the grooves 92 for receiving the posts 34 of the side frames are nesting grooves 94 which extend between the pairs of stake pockets 22 at the opposite ends of the pallet 12. Provided for permitting the pallet 12 to be lifted by a fork lift truck positioned at either side of the pallet are a parallel pair of crosswise extending fork tine grooves 96 which, as viewed in FIG. 4, straddle a zone located between the sets of wheel wells 58 and 62.

In order to interlock end-to-end arranged stacks of the stands 10, the central portion of the left end of the pallet 12, as viewed in FIG. 1, is provided with a forwardly extending interlock projection 98 while the central portion of the right end of the pallet is provided with an interlock recess 100 shaped complementary to the projection. Thus, when forming a second stack of three loaded shipping stands 10 to the right of those shown in FIG. 6, the bottom stand 10 and each subsequently added stand of the new stack would be positioned with its projection 98 seated in the recess 100 of that stand 10 of the original stack located at the same level as the stand of the new stack.

The operation of the knockdown stacking stand 10 is summarized as follows. Starting at a factory or some other location where a plurality of lawn and garden tractors 54 and mower decks 56 have been accumulated for shipping, each tractor 54 is driven into place on a first one of a plurality of the pallets 12 with its rear and front pairs of wheels 60 and 64 respectively received in the pairs of wheel wells 58 and 62. A mower deck 56 is then manually positioned between the rear and front wheels of the tractor 54 with the front roller 76 of the mower received in the roller receptacle 74. Tie down straps or the like not shown, may then be installed to hold the tractor and mower deck against the pallet. The stacking framework 14 is then assembled by erecting the side frames 30 and 32 with the end posts 34 of the latter being inserted into the stake pockets 20. The braces 40 are then installed to rigidify the framework 14. A first stacking stand 10 has thus been assembled and is then ready for placement on the bed of a hauling conveyance such as a truck trailer, shipping container or rail car bed, for example. Such placement is accomplished by driving a fork lift truck towards either the ends or sides of the pallet so as to insert the fork tines thereof either into the tine grooves 92 or into the tine grooves 96. Once properly engaged by the fork lift truck, the pallet is lifted onto and positioned appropriately on the bed of the hauling conveyance to permit a maximum number of pallets to be loaded for shipment. A second stacking stand 10 is then similarly loaded with a second tractor 54 and mower deck 56, and is stacked atop the first stacking stand 10 on the shipping conveyance bed by using the fork lift truck. In the event, the pallet 12 of the second shipping stand 10 is slightly vertically misaligned relative to the framework 14 of the first shipping stand 10 when lowered theretoward by the fork lift, the inclined entrance portions 28 of the pockets 22 will serve to guide the top portions 38 of the posts 34 into the pockets 22. Once properly seated on the posts 34 of the first stand, the pallet 12 of the second stand will rest against the support members 36 of the side frames 30 and 32 of the first stand. It should be noted that at this time the upper portions of the seat 88 and hood 90 of the tractor 54 carried by the first frame 10 are respectively positioned within the seat and hood clearance cavities 84 and 86. A third stacking stand 10 is then similarly loaded and stacked atop the second stacking stand. This process is continued until the bed of the hauling conveyance is completely loaded with three-high stacks of stands 10 with it being noted that adjacent fore-and-aft aligned columns of three-high stacks are positioned such that the interlock projections 98 of the pallets 12 of one column enter the interlock recesses 100 of the adjacent column.

Once the shipped stacking stands have reached their destination, a fork lift is used to unload them from the shipping conveyance generally in reverse order from the way they were loaded. The shipping stands may be used to stack the tractors 54 and mower decks 56 in inventory or the tractors and mower decks may be removed from the stacking stands 10 with the latter then being dismantled. The stands 10 are each dismantled by removing the lower ends of the braces 40 from the pins 44 and rotating the braces 40 upwardly and connecting them to the pins 46. The side frames 30 and 32 are then lifted from the stake pockets 26 and placed in the nesting grooves 48. The frames 30 and 32 extend above the nesting grooves 48 and knocked-down stands 10 can be stacked one atop another by disposing the frames 30 and 32 of the lower one within the tine grooves 92 and nesting grooves 94 of the upper one. The knocked-down stands 10 are then accumulated until a sufficient number is on hand to make up a full load whereupon they are shipped back to their place of origin to be reused for the shipping tractors and mower decks.

I claim:

1. A stackable, knockdown shipping stand for a multi-wheeled motor vehicle, comprising: a pallet forming a generally horizontal base of the stand and being generally rectangular in plan view so as to define four corners and having upper and lower surfaces; upper and lower, vertically aligned stake pockets being located adjacent each corner; a stacking framework including four vertical posts, each having a lower end releasably received in a respective one of the upper stake pockets and having an upper end adapted for reception in a respective one of lower stake pockets of a pallet like said pallet; brace means releasably attached between each post and the pallet; nesting groove means provided in the upper surface of the pallet for receiving the framework in a knocked-down condition; wheel engaging means located on the upper surface of the pallet adapted for engaging each of the wheels of a motor vehicle to be loaded on the pallet so as to stabilize the vehicle for shipping.

2. The shipping stand defined in claim 1 wherein said pallet is provided with lift fork tine receptacle means for permitting the pallet to be liftingly engaged by the tines of a fork lift truck positioned at any side or end of the pallet.

3. The shipping stand defined in claim 1 wherein opposite ends of the pallet are respectively provided with an interlocking projection and a complementary shaped interlocking recess whereby multiple stands may be loaded end-to-end on a shipping conveyance with the projection of a first pallet being received within the recess of an adjacent pallet to thereby interlock the load.

4. The shipping stand defined in claim 1 wherein the pallet is formed from injection molded plastic material.

5. The shipping stand defined in claim 1 wherein each set of vertically aligned stake pockets are formed by a metal insert molded into the plastic material.

6. The shipping stand defined in claim 1 wherein said framework includes a first horizontal support member interconnecting a first pair of the posts located towards a first side of the pallet to thereby establish a first side frame and a second horizontal support member interconnecting a second pair of the posts located towards a second side of the pallet to thereby establish a second side frame; and the first and second support members being spaced downwardly from respective tops of the posts a distance commensurate with the depth of the lower stake pockets; whereby a pallet which has the upper ends of the posts received in the lower stake pockets thereof will rest on the first and second support members.

7. The shipping stand defined in claim 6 wherein first and second pairs of the brace means are respectively located to brace the first and second side frames from tilting sideways.

8. The shipping stand defined in claim 1 wherein the wheel engaging means includes a plurality of wheel wells for respectively receiving the wheels of a vehicle to be loaded on the pallet.

9. The shipping stand defined in claim 8 wherein each wheel well includes a plurality of ribs running lengthwise of the well and said rib having respective upper concave surfaces cooperating to form a double ramp extending to the upper surface of the pallet for permitting a wheel to smoothly enter and leave the well.

10. The shipping stand defined in claim 1 wherein said nesting groove means has a depth of no more than half of the height of the framework when nested in the groove means; and a second nesting groove means being provided in a lower surface of the pallet for permitting pallets to be stacked one atop another with the framework located in the nesting groove means of a lower pallet being received within the second nesting groove means of an upper pallet.

11. The shipping stand defined in claim 10 wherein the second nesting groove means is at least partially defined by a pair of lift fork tine grooves extending lengthwise of the pallet.

12. The shipping stand defined in claim 1 wherein the upper stake pockets extend to a depth greater than that of the lower stake pockets and the total depth of aligned ones of the upper and lower stake pocket is less than the thickness of the pallet at respective zones containing said aligned ones of the stake pockets whereby a wall separates the bottoms of said aligned ones of the stake pockets.

13. The shipping stand defined in claim 1 wherein the lower surface of the pallet contains at least one clearance cavity adapted for providing clearance for upper portions of the wheeled vehicle which extend above a level commensurate with top end portions of said posts hereby a pallet may be received on the top end portions of the posts without interfering with a wheeled vehicle located therebeneath.

14. A stackable, knockdown shipping stand for a lawn and garden tractor, comprising: a horizontal, flat generally boxlike pallet forming a base of the stand and having upper and lower surfaces; four upper stake pockets formed in the upper surface in a rectangular pattern and four lower stake pockets formed in the lower surface respectively in alignment with the four upper stake pockets; a stacking framework including four posts respectively slidably received in the four upper stake pockets; securing means releasably attached between each post and the pallet for releasably retaining the posts in place; and wheel locating means defined by the upper surface of the pallet for engaging and restraining movement of wheels of the tractor.

15. The shipping stand defined in claim 14 wherein the upper surface of the pallet is provided with nesting groove means for holding the framework on the pallet after the framework is dismantled.

16. The shipping stand defined in claim 14 wherein first and second pairs of said four posts are respectively interconnected by first and second horizontal support members located at a level below respective tops of the posts thus leaving post end portions above the support members which are of a length commensurate with the depth of the lower stake pockets whereby a pallet stacked with the post end portions received in its lower stake pockets will rest on the support members.

17. The shipping stand defined in claim 16 wherein the pallet is formed of injection molded plastic and the posts and support members are formed of tubular structural steel.

18. The shipping stand defined in claim 14 wherein said securing means comprises four strap-like braces respectively having first ends coupled to the four posts at about mid height of the latter and having respective second ends coupled to the pallet.

19. The shipping stand defined in claim 14 wherein opposite ends of the pallet are respectively provided centrally with an interlock projection and an interlock recess shaped complementary to the projection whereby when multiple stands are located end-to-end, the projection of one pallet can be located in the recess of an adjacent pallet.

20. The shipping stand defined in claim 14 wherein a first pair of the four posts located at one side of the pallet are interconnected by a first horizontal support member to thereby form a first side frame and a second pair of the four posts located at another side of the pallet are interconnected by a second horizontal support member to thereby form a second side frame.

21. The shipping stand defined in claim 20 wherein the nesting groove means extends between and intersects the four upper stake pockets and includes opposite side portions extending lengthwise of the pallet, for receiving the first and second support members, and opposite end portions extending crosswise of the pallet for receiving the posts.

22. The shipping stand defined in claim 14 wherein the lower stake pockets each include a flared entrance portion adapted for guiding the pallet onto upper end portions of posts of a stacking stand located beneath it.

23. The shipping stand defined in claim 14 and further including a rotary lawn mower gauge roller receptacle located in the upper surface of the pallet whereby a rotary lawn mower deck equipped with a front gauge roller may be supported on the pallet with its roller received in the receptacle.

24. The shipping stand defined in claim 23 wherein said pallet includes a side portion located for underlying and protecting a discharge portion of a rotary lawn mower deck carried by the pallet.

25. The shipping stand defined in claim 14 and further including fork tine receptacles means provided in the pallet for receiving the tines of a fork lift truck.

* * * * *